US005603405A

United States Patent [19]

Smith

[11] Patent Number: 5,603,405

[45] Date of Patent: Feb. 18, 1997

[54] LADDER TOP STORAGE RACK

[76] Inventor: William H. Smith, 1545 San Andreas Rd. #2, La-Selva Beach, Calif. 95076

[21] Appl. No.: 565,813

[22] Filed: Nov. 30, 1995

[51] Int. Cl.[6] ..... B65D 85/20; E06C 7/14

[52] U.S. Cl. ..... 206/373; 206/349; 248/210; 182/129

[58] Field of Search ..... 206/373, 372, 206/349; 248/210, 211, 238; 190/115; 383/38, 39; 182/129

[56] References Cited

U.S. PATENT DOCUMENTS

| | | | |
|---|---|---|---|
| D. 317,206 | 5/1991 | Cagle | 206/234 |
| 2,758,798 | 8/1956 | Schmidt | 206/373 |
| 4,310,134 | 1/1982 | Schopp et al. | 248/210 |
| 4,356,854 | 11/1982 | McGee | 383/38 |
| 4,653,713 | 3/1987 | Hamilton | 248/238 |
| 4,768,651 | 9/1988 | Lanius | 206/373 |
| 4,773,535 | 9/1988 | Cook | 206/373 |
| 4,874,119 | 10/1989 | Winter | 206/373 |
| 4,874,147 | 10/1989 | Ory et al. | 248/210 |
| 4,966,259 | 10/1990 | Bergman | 190/115 |
| 5,333,823 | 8/1994 | Joseph | 248/210 |
| 5,505,302 | 4/1996 | Ferley | 206/373 |

*Primary Examiner*—Bryon P. Gehman
*Assistant Examiner*—Luan K. Bui

[57] ABSTRACT

A ladder top storage rack includes a rigid tool box having securable to a ladder top. A pair of side pouches are secured to two side walls of the tool box. Each of the side pouches has a zippered opening. A rear pouch is secured to the rear wall of the tool box. The rear pouch has a zippered opening.

2 Claims, 3 Drawing Sheets

LADDER TOP STORAGE RACK

BACKGROUND OF THE INVENTION

1. Field of the Invention

The present invention relates to a ladder top storage rack and more particularly pertains to securing to a top of a ladder to keep tools and fasteners in reach with a ladder top storage rack.

2. Description of the Prior Art

The use of device-holding devices for ladders is known in the prior art. More specifically, device-holding devices for ladders heretofore devised and utilized for the purpose of holding various implements are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,653,713 to Hamilton discloses a ladder top tool tray mounting.

U.S. Pat. No. 5,333,823 to Joseph discloses a detachable device-holding apparatus for a stepladder.

U.S. Pat. No. Des. 317,206 to Cagle discloses the ornamental design for a ladder bag tool holder.

U.S. Pat. No. 5,123,620 to Bourne discloses an accessory container for ladder.

U.S. Pat. No. 4,310,134 to Schopp et al. discloses a step ladder utility box.

U.S. Pat. No. 4,300,740 to Killian discloses an easily movable shelf for step ladder.

U.S. Pat. No. Des. 297,263 to Paci discloses the ornamental design for a combined siding guard, work top and tool rest for ladder tops.

While these devices fulfill their respective, particular objective and requirements, the aforementioned patents do not describe a ladder top storage rack for securing to a top of a ladder to keep tools and fasteners in reach.

In this respect, the ladder top storage rack according to the present invention substantially departs from the conventional concepts and designs of the prior art, and in doing so provides an apparatus primarily developed for the purpose of securing to a top of a ladder to keep tools and fasteners in reach.

Therefore, it can be appreciated that there exists a continuing need for new and improved ladder top storage rack which can be used for securing to a top of a ladder to keep tools and fasteners in reach. In this regard, the present invention substantially fulfills this need.

SUMMARY OF THE INVENTION

In the view of the foregoing disadvantages inherent in the known types of device-holding devices for ladders now present in the prior art, the present invention provides an improved ladder top storage rack. As such, the general purpose of the present invention, which will be described subsequently in greater detail, is to provide a new and improved ladder top storage rack and method which has all the advantages of the prior art and none of the disadvantages.

To attain this, the present invention essentially comprises a rigid tool box having a generally rectangular configuration. The tool box has an open top, a closed bottom, a front wall, a rear wall, and two side walls. The open top has a lid hingedly secured thereto. The lid has a carrying handle secured thereto. A front edge of the lid has a securement clasp secured thereon cooperating with a pivotal securement hook on the front wall for locking of the lid over the open top of the tool box. The device includes a pair of longitudinal securement straps each having end portions secured to opposing ends of the closed bottom of the tool box. Free ends of the securement straps extend lengthwise beneath a ladder top for coupling together. The device includes a pair of latitudinal securement straps each having end portions secured to opposing sides of the closed bottom of the tool box. Free ends of the latitudinal securement straps extend widthwise beneath a ladder top for coupling together. A pair of side pouches are secured to the two side walls of the tool box. Each of the side pouches has a zippered opening. A rear pouch is secured to the rear wall of the tool box. The rear pouch has a zippered opening.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ladder top storage rack which has all the advantages of the prior art device-holding devices for ladders and none of the disadvantages.

It is another object of the present invention to provide a new and improved ladder top storage rack which may be easily and efficiently manufactured and marketed.

It is a further object of the present invention to provide a new and improved ladder top storage rack which is of durable and reliable construction.

An even further object of the present invention is to provide a new and improved ladder top storage rack which is susceptible of a low cost of manufacture with regard to both materials and labor, and which accordingly is then susceptible of low prices of sale to the consuming public, thereby making such a ladder top storage rack economically available to the buying public.

Still yet another object of the present invention is to provide a new and improved ladder top storage rack which provides in the apparatuses and methods of the prior art some of the advantages thereof, while simultaneously overcoming some of the disadvantages normally associated therewith.

Even still another object of the present invention is to provide a new and improved ladder top storage rack for securing to a top of a ladder to keep tools and fasteners in reach.

Lastly, it is an object of the present invention to provide a new and improved ladder top storage rack includes a rigid tool box having means for securement to a ladder top. A pair of side pouches are secured to two side walls of the tool box. Each of the side pouches has a zippered opening. A rear pouch is secured to the rear wall of the tool box. The rear pouch has a zippered opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
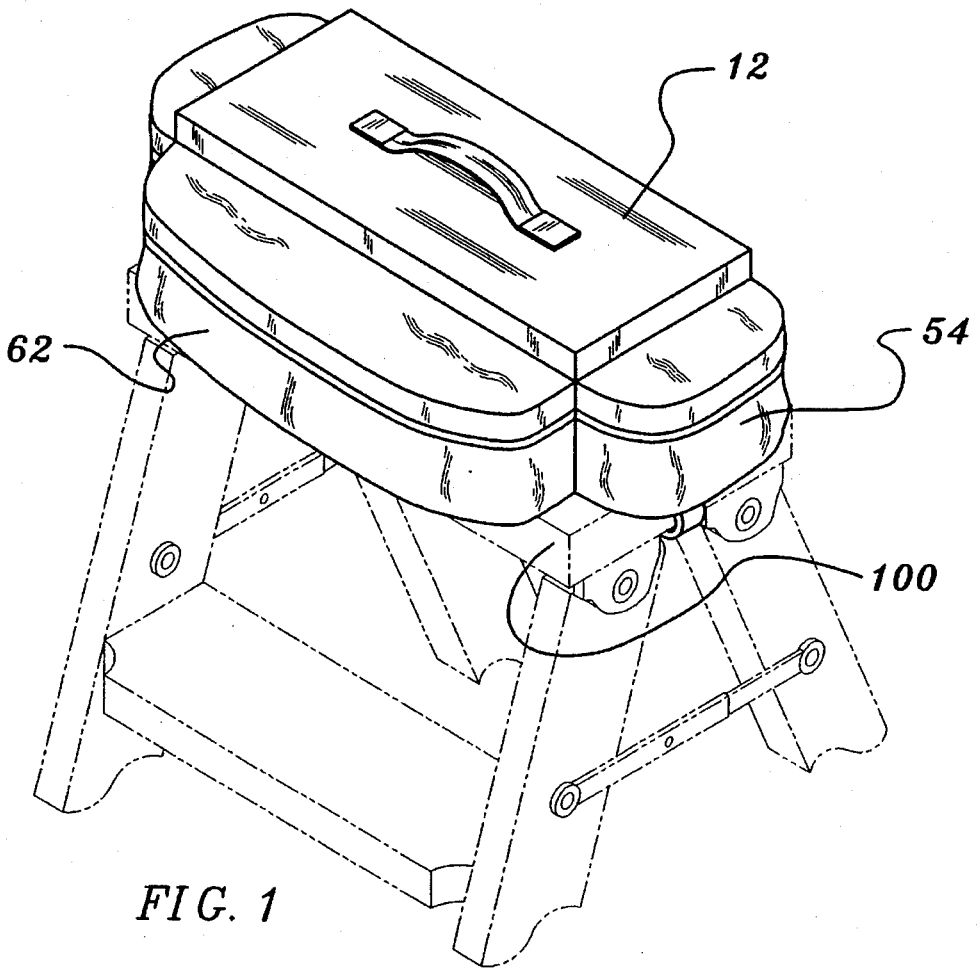
FIG. 1 is a perspective view of the preferred embodiment of the ladder top storage rack constructed in accordance with the principles of the present invention.
Figure 2:
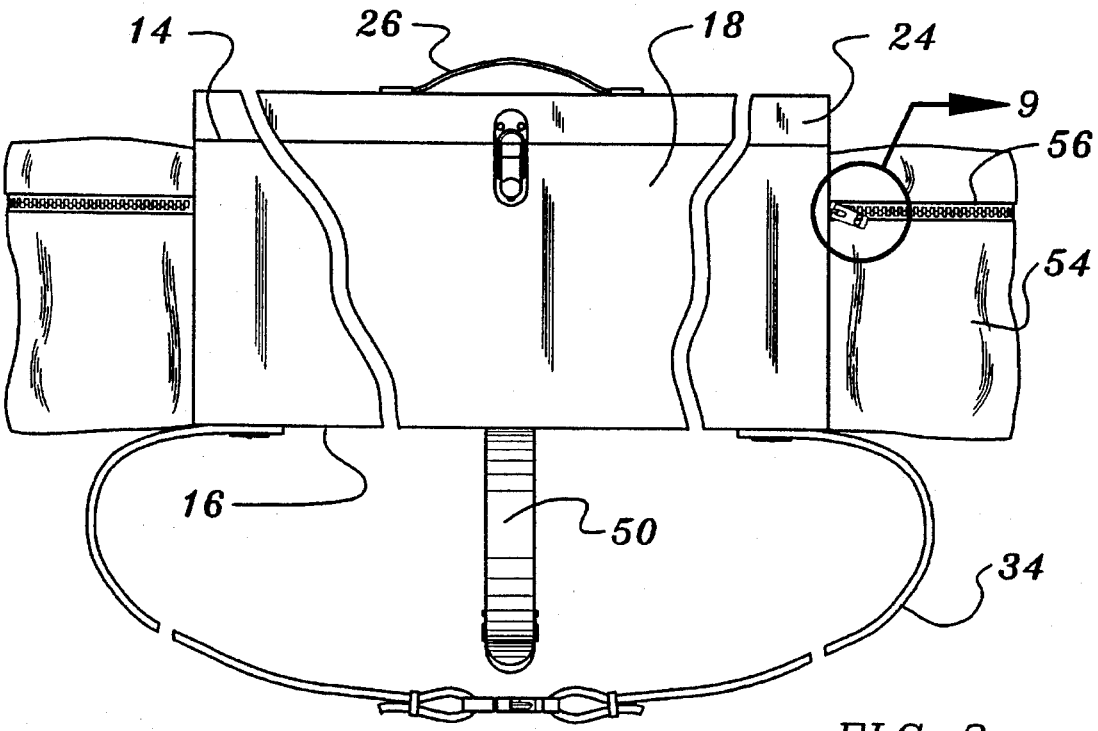
FIG. 2 is a front elevation view of the present invention.
Figure 3:
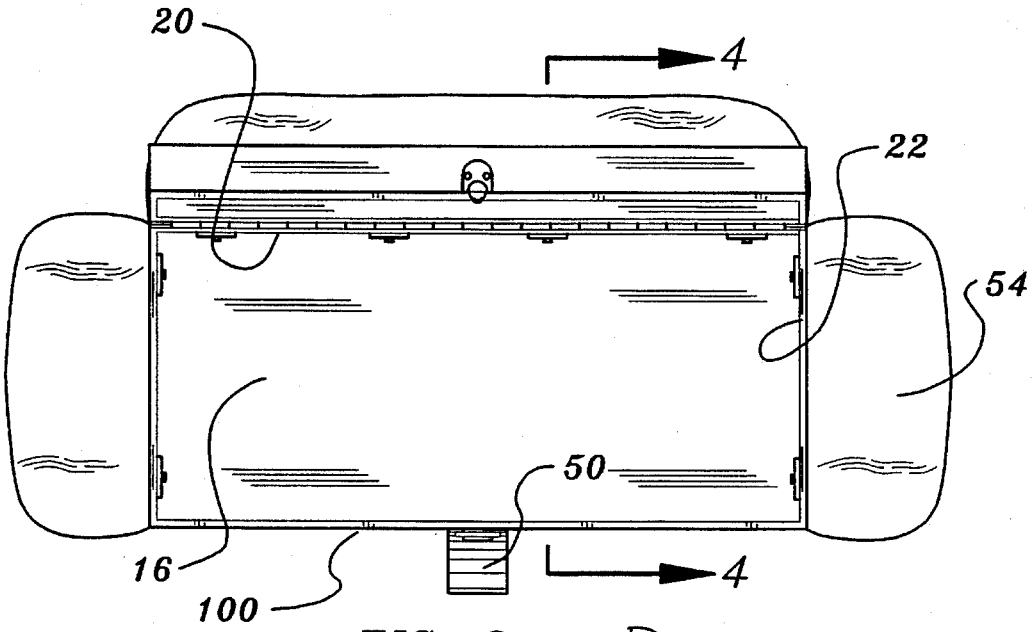
FIG. 3 is a plan view of the present invention with the lid in an open position.
Figure 4:
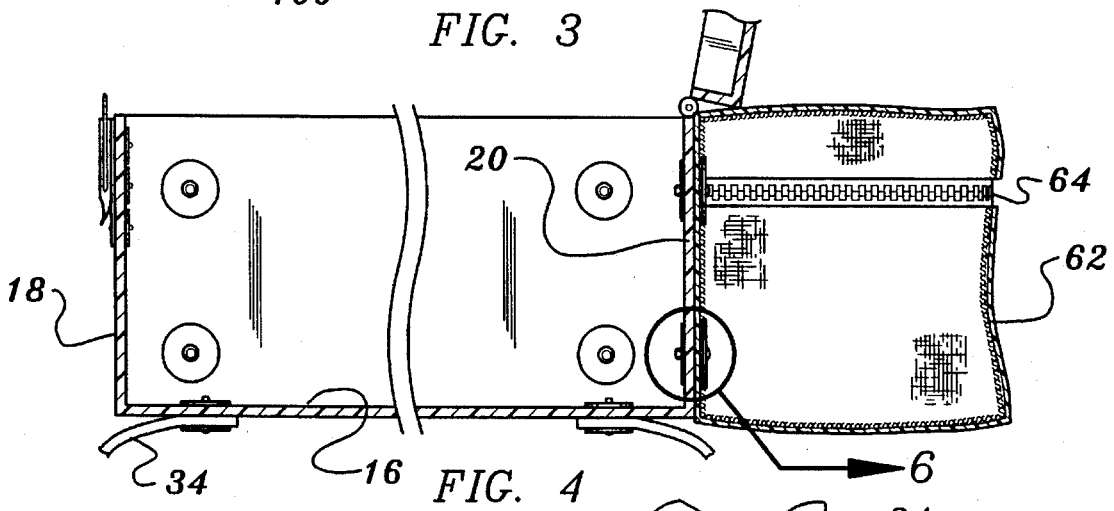
FIG. 4 is a cross-sectional view as taken along line 4—4 of FIG. 3.
Figure 5A:
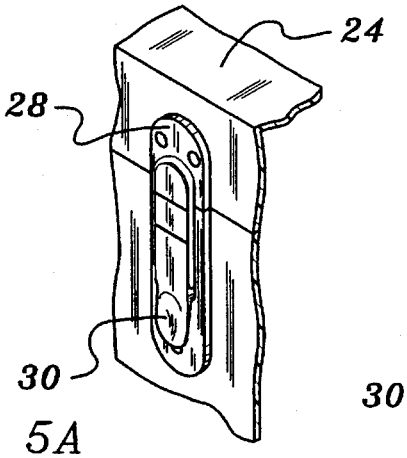
FIG. 5*a* and 5*b* are perspective view of the clasp on the lid of the present invention.
Figure 5B:
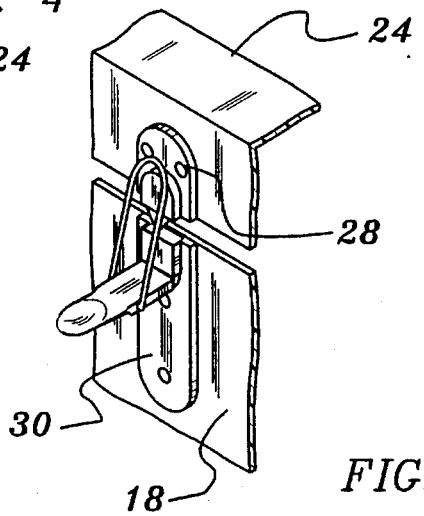
Figure 6:
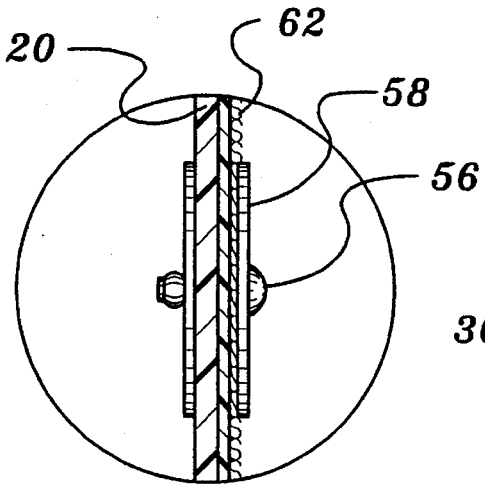
FIG. 6 is a side view of the side pouch secured to the tool box.
Figure 7:
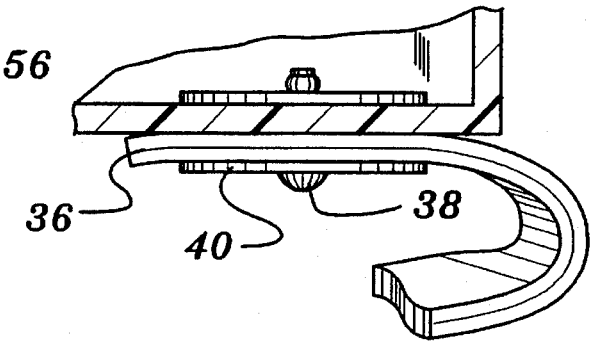
FIG. 7 is a side view of the securement strap secured to the bottom of the tool box.
Figure 8:
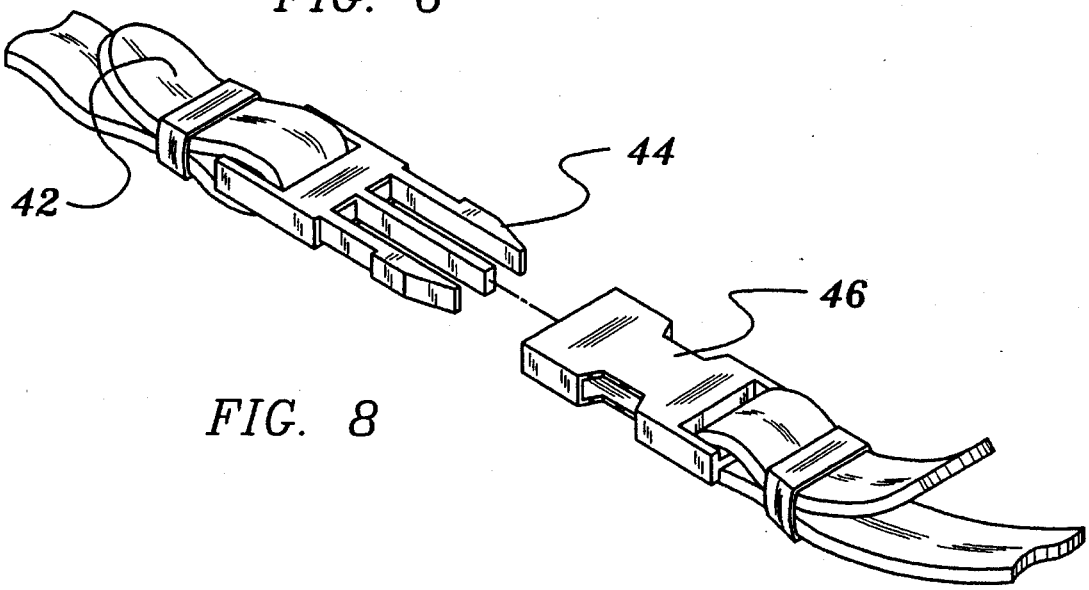
FIG. 8 is a perspective view of the coupling ends of the securement strap.
Figure 9:
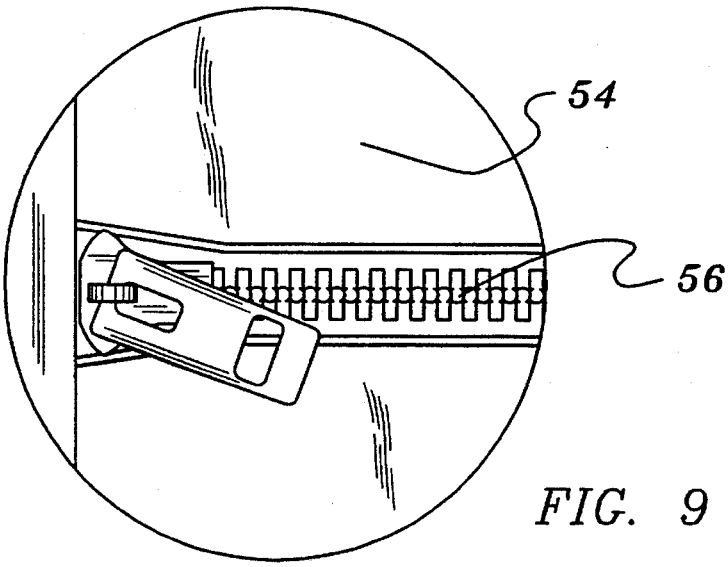
FIG. 9 is a front view of the zippered closure of the side pouch.

With reference now to the drawings, and in particular, to FIG.'s 1–9 thereof, the preferred embodiment of the new and improved ladder top storage rack embodying the principles and concepts of the present invention and generally designated by the reference number 10 will be described.

Specifically, it will be noted in the various Figures that the device relates to a new and improved ladder top storage rack for securing to a top of a ladder to keep tools and fasteners in reach. In its broadest context, the device consists of a rigid tool box, a pair of longitudinal securement straps, a pair of latitudinal securement straps, a pair of side pouches, and a rear pouch. Such components are individually configured and correlated with respect to each other so as to attain the desired objective.

The device 10 includes a rigid tool box 12 having a generally rectangular configuration. The tool box 12 has an open top 14, a closed bottom 16, a front wall 18, a rear wall 20, and two side walls 22. The open top 14 has a lid 24 hingedly secured thereto. The lid 24 has a carrying handle 26 secured thereto. A front edge of the lid 24 has a securement clasp 28 secured thereon cooperating with a pivotal securement hook 30 on the front wall 18 for locking of the lid 24 over the open top 14 of the tool box 12. The securement clasp 28 coupled with the pivotal securement hook 30 prevent the tool box 12 from accidentally opening. The tool box 12 is constructed of a rigid material such as wood or metal or luggage grade polypropylene. The tool box 12 is dimensioned to contain any number of tools.

The device 10 includes a pair of longitudinal securement straps 34 each having end portions 36 secured to opposing ends of the closed bottom 16 of the tool box 12. The end portions 36 are secured to the closed bottom by rivets 38 extending through a pair of washers 40. Free ends 42 of the securement straps 34 extend lengthwise beneath a ladder top 100 for coupling together. Each of the free ends 42 has a snap together buckle, one being male 44 and the other being female 46, thus allowing for fast and easy attachment and detachment of the tool box 12 to the ladder top 100.

The device 10 includes a pair of latitudinal securement straps 50 each having end portions 36 secured to opposing sides of the closed bottom 16 of the tool box 12. The end portions 36 are secured to the closed bottom by rivets 38 extending through a pair of washers 40. Free ends 42 of the latitudinal securement straps 50 extend widthwise beneath a ladder top 100 for coupling together. Each of the free ends 42 has a snap together buckle, one being male 44 and the other being female 46, thus allowing for fast and easy attachment and detachment of the tool box 12 to the ladder top 100.

A pair of side pouches 54 are secured to the two side walls 22 of the tool box 12. Each of the side pouches 54 has a zippered opening 56. The pair of side pouches 54 are secured to the side walls 20 of the tool box by a rivet 56 extending through the side wall 20 through two washers 58. The pair of side pouches 54 are utilized for holding nails, nuts, bolts, screws, and other miscellaneous small items.

A rear pouch 62 is secured to the rear wall 20 of the tool box 12. The rear pouch 62 has a zippered opening 64. The rear pouch 62 is secured to the rear wall 20 of the tool box 12 by a rivet 56 extending through the side wall 20 through two washers 58. The rear pouch 62 is utilized for holding nails, nuts, bolts, screws, and other miscellaneous small items.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A ladder top storage rack for securing to a top of a ladder to keep tools and fasteners in reach comprising, in combination:

a rigid tool box having a generally rectangular configuration, the tool box having an open top, a closed bottom, a front wall, a rear wall, and two side walls, the open top having a lid hingedly secured thereto, the lid having a carrying handle secured thereto, a front edge of the lid having a securement clasp secured thereon cooperating with a pivotal securement hook on the front wall for locking of the lid over the open top of the tool box;

a pair of adjustable longitudinal securement straps each having end portions secured to opposing ends of the closed bottom of the tool box, free ends of the securement straps extending lengthwise beneath a ladder top for coupling together;

a pair of adjustable latitudinal securement straps each having end portions secured to opposing sides of the closed bottom of the tool box, free ends of the latitudinal securement straps extending widthwise beneath a ladder top for coupling together;

a pair of side pouches secured to the two side walls of the tool box, each of the side pouches having a zippered opening;

a rear pouch secured to the rear wall of the tool box, the rear pouch having a zippered opening.

2. The storage rack as set forth in claim 1 wherein one of the free ends of the pair of longitudinal securement straps having a male securement clasp cooperating with a female securement clasp on a free end on an opposing securement strap.

* * * * *